US007499000B2

(12) United States Patent
Chan et al.

(10) Patent No.: US 7,499,000 B2
(45) Date of Patent: Mar. 3, 2009

(54) ANTENNA DEVICE HAVING COMPACT COVERING

(75) Inventors: Yat To Chan, Tauyuan Hsien (TW); Yuh Ching Tsen, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 393 days.

(21) Appl. No.: 11/329,517

(22) Filed: Jan. 11, 2006

(65) Prior Publication Data

US 2007/0159403 A1 Jul. 12, 2007

(51) Int. Cl.
*H01Q 1/42* (2006.01)

(52) U.S. Cl. ..... 343/872; 343/702

(58) Field of Classification Search ..... 343/872

See application file for complete search history.

(56) References Cited

U.S. PATENT DOCUMENTS 5,828,339 A * 10/1998 Patel ..... 343/700 MS
5,900,840 A * 5/1999 Yajima ..... 343/713
5,973,645 A 10/1999 Zigler et al. ..... 343/702
7,218,284 B2 * 5/2007 Aizawa et al. ..... 343/713
7,333,065 B2 * 2/2008 Lindackers et al. ..... 343/713

* cited by examiner

*Primary Examiner*—Trinh V Dinh
(74) *Attorney, Agent, or Firm*—Charles E. Baxley

(57) ABSTRACT

An antenna device includes an antenna member having a plate, a conductor member disposed on one side of the plate, and another conductor member disposed on the other side of the plate, the plate includes one or more orifices and one or more apertures, and a coupler includes one or more positive electrodes and one or more negative electrodes engaged through the orifices and the apertures of the antenna member and electrically coupled to the conductor members respectively. A housing includes a chamber for receiving the plate of the antenna member, and a cylindrical member having a bore for receiving the coupler. The housing includes two housing members having a chamber for receiving the plate.

5 Claims, 5 Drawing Sheets

ANTENNA DEVICE HAVING COMPACT COVERING

BACKGROUND OF THE INVENTION

1. Field of the Invention

The present invention relates to an antenna device, and more particularly to an antenna device having a compact covering device for covering and storing an antenna member therein and for rotatably or pivotally attaching or coupling the antenna device to various electric or radio facilities.

2. Description of the Prior Art

Typical antenna devices comprise an antenna member engaged in an outer housing for rotatably or pivotally attached or coupled to various electric or radio facilities, such as portable or mobile phones, motor vehicles, global positioning systems, computer facilities, radio apparatuses or communications, etc.

For example, U.S. Pat. No. 5,973,645 to Zigler et al. discloses one of the typical antenna devices comprising an antenna member engaged in an outer housing, and a complicated pivotal coupling structure for rotatably or pivotally attaching or coupling the antenna member and/or the outer housing to various electric or radio facilities, such as portable or mobile phones.

However, a complicated coupling structure or a number of pivotal or coupling members or elements are required to be provided and coupled between the antenna member and/or the outer housing and/or the electric or radio facilities for allowing the antenna member and/or the outer housing to be coupled to the electric or radio facilities.

The present invention has arisen to mitigate and/or obviate the afore-described disadvantages of the conventional antenna devices.

SUMMARY OF THE INVENTION

The primary objective of the present invention is to provide an antenna device including a compact covering device for covering and storing an antenna member therein and for rotatably or pivotally attaching or coupling the antenna device to various electric or radio facilities.

In accordance with one aspect of the invention, there is provided an antenna device comprising an antenna member including a plate, and including a first conductor member disposed on a first side of the plate, and including a second conductor member disposed on a second side of the plate, and including at least one orifice and at least one aperture formed in the plate, and the orifice and the aperture of the antenna member being separated from each other, and a coupler including at least one positive electrode and at least one negative electrode extended and engaged through the orifice and the aperture of the antenna member respectively, and electrically coupled to the first and the second conductor members respectively.

The antenna member includes at least one hole formed in one end of the plate, and/or the antenna member includes at least one notch formed in a middle portion of the plate for anchoring or positioning purposes.

A housing may further be provided and includes a chamber for receiving the plate of the antenna member. The housing includes a cylindrical member having a bore formed in the cylindrical member for pivotally receiving the coupler. The coupler includes an end extended out of the cylindrical member.

The housing includes a first housing member having a chamber for receiving the plate of the antenna member, the cylindrical member is extended from the first housing member.

The first housing member includes at least one peg for engaging with the antenna member and for anchoring the antenna member in the chamber of the housing, or the housing member includes at least one swelling for engaging with the antenna member and for anchoring the antenna member in the chamber of the housing.

The first housing member includes at least one depression, the housing includes a second housing member attached onto the first housing member and having at least one projection for engaging into the depression of the first housing member and for securing the first and the second housing members together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
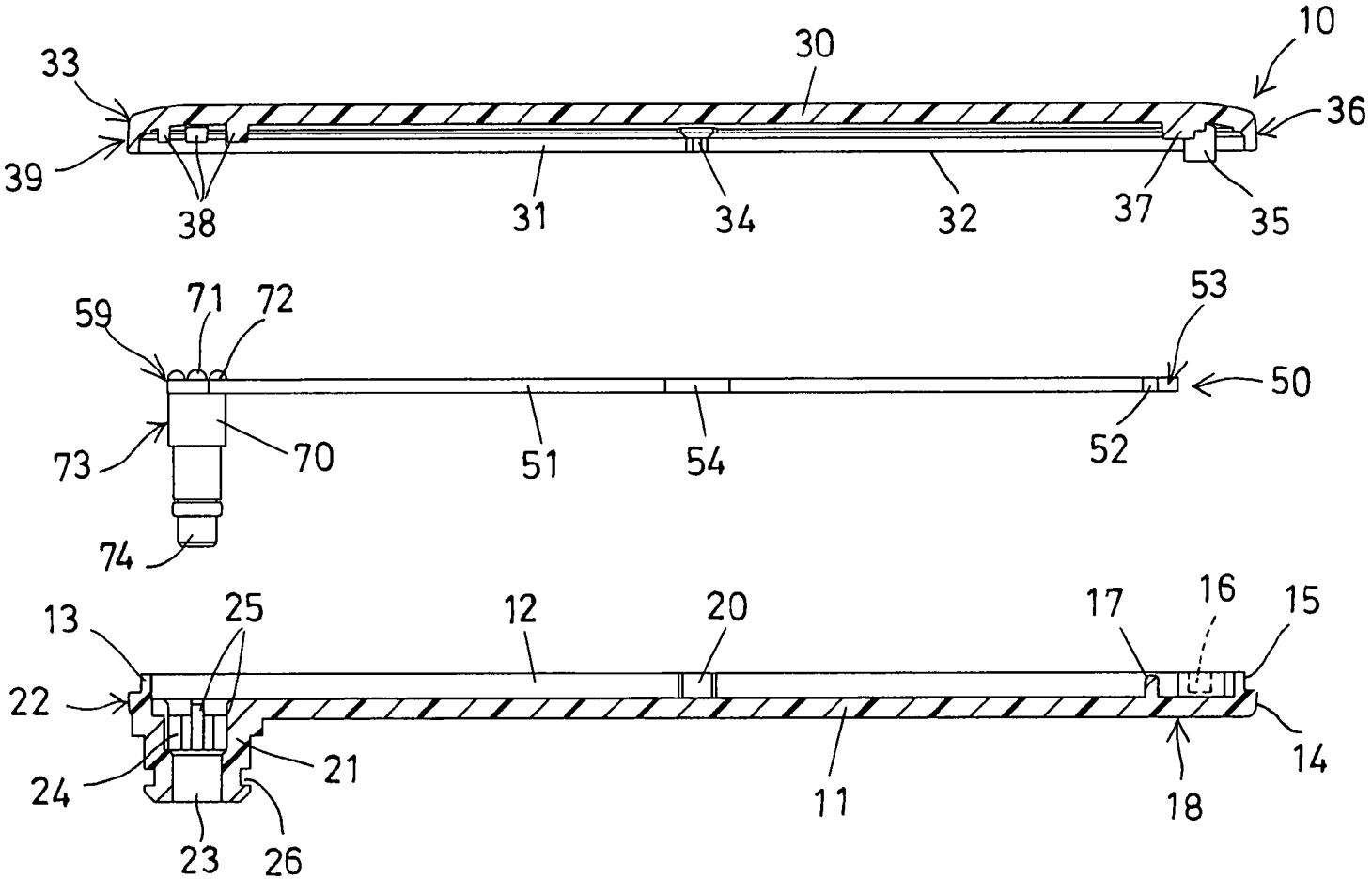
FIG. 1 is an exploded and cross sectional view of an antenna device in accordance with the present invention.
Figure 2:
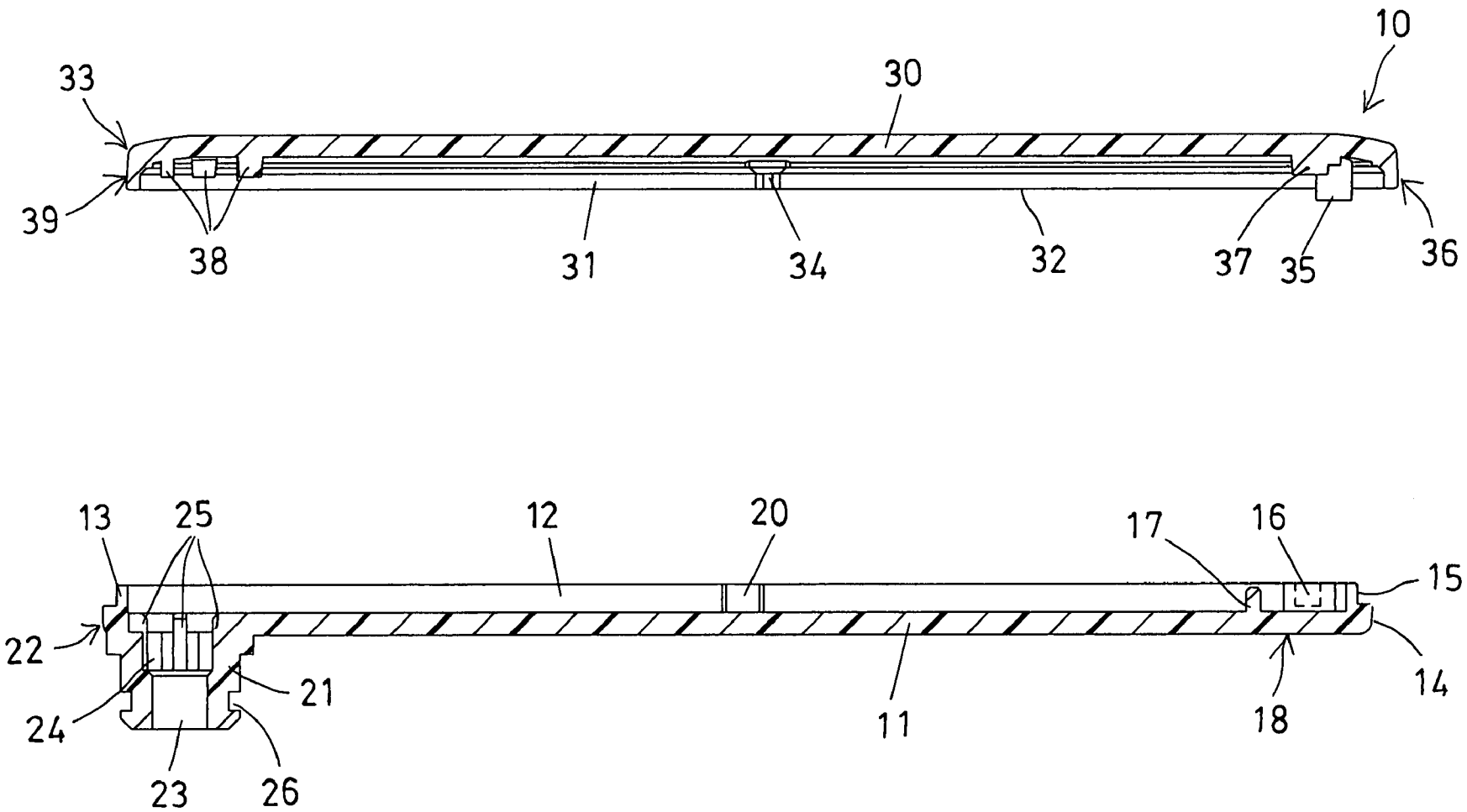
FIG. 2 is an exploded and cross sectional view illustrating an outer housing of the antenna device.
Figure 3:
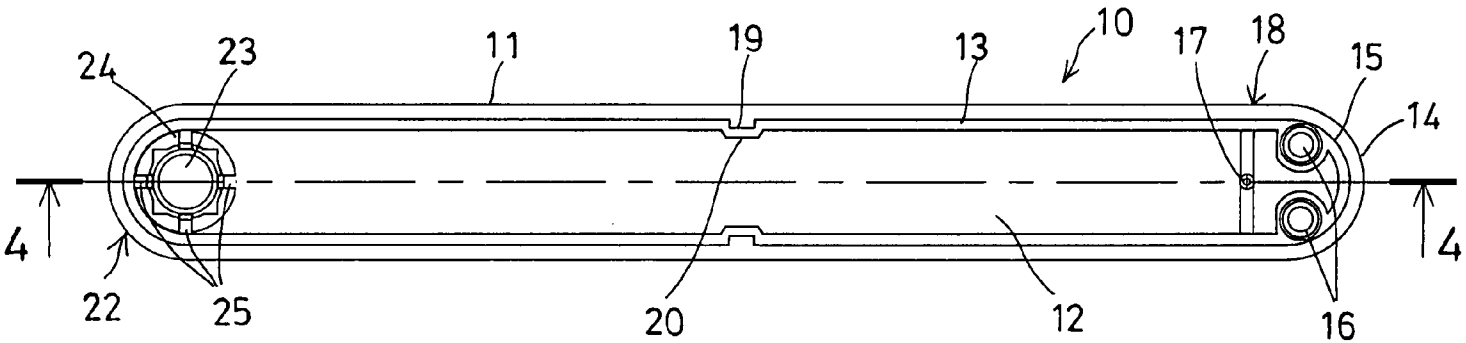
FIG. 3 is a top plan view of a lower housing member of the outer housing of the antenna device.
Figure 4:
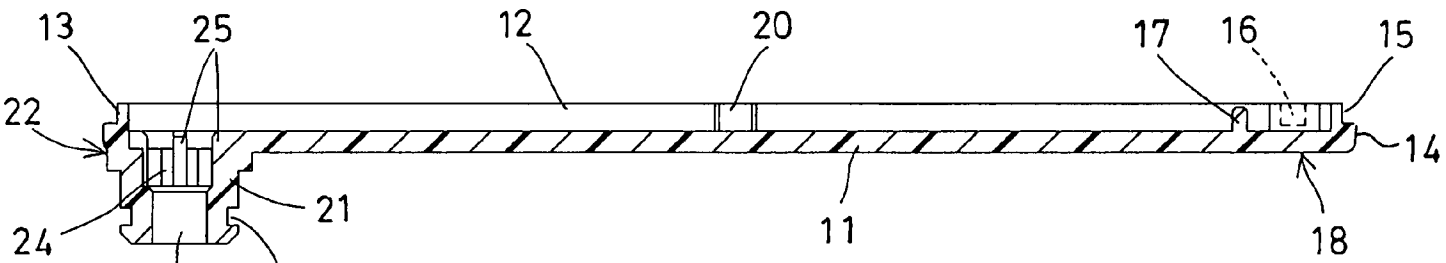
FIG. 4 is a cross sectional view of the lower housing member, taken along lines 4-4 of FIG. 3.
Figure 5:
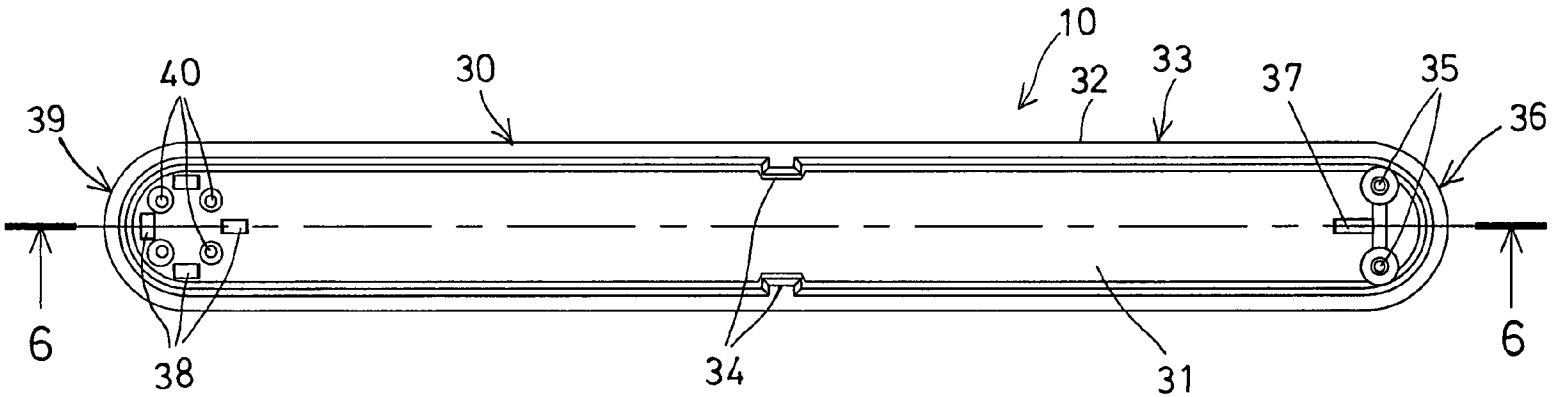
FIG. 5 is a bottom plan view of an upper housing member of the outer housing of the antenna device.
Figure 6:
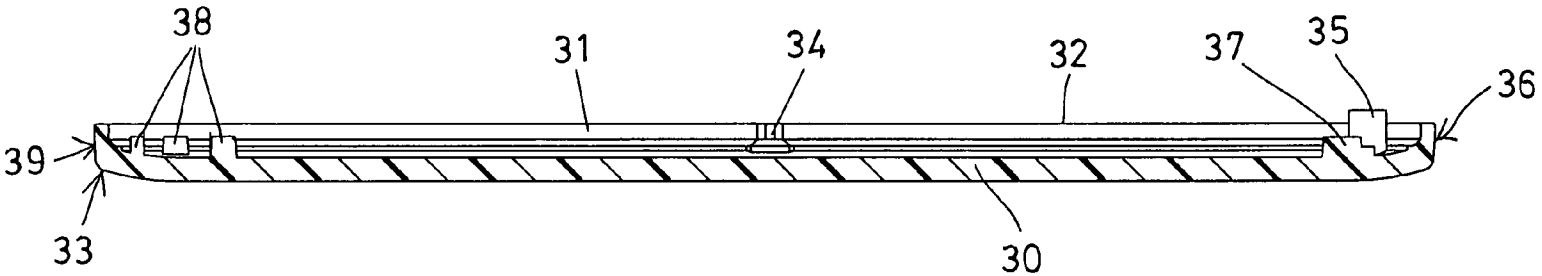
FIG. 6 is a cross sectional view of the lower housing member, taken along lines 6-6 of FIG. 5.

Referring to the drawings, and initially to FIGS. 1 and 2, an antenna device in accordance with the present invention comprises an outer housing 10, and an antenna member 50 to be disposed or engaged into the outer housing 10 of the antenna device. The housing 10 includes a first or lower housing member 11 having a chamber 12 formed in the upper portion thereof, and having an outer peripheral fence 13 extended upwardly from the outer peripheral portion 14 of the lower housing member 11 for forming or defining the chamber 12 of the lower housing member 11 and for receiving and storing the antenna member 50.

The peripheral fence 13 of the lower housing member 11 is located slightly and/or radially inward of the outer peripheral portion 14 of the lower housing member 11 for forming or defining an outer peripheral shoulder 15 in the outer peripheral portion 14 of the lower housing member 11. The lower housing member 11 includes one or more depressions 16 and one or more pegs 17 formed or extended from one end 18 of the lower housing member 11 and preferably located within or communicating with the chamber 12 of the lower housing member 11.

The lower housing member 11 further includes one or more recesses 19 formed in the outer peripheral fence 13 and preferably facing radially and outwardly of the lower housing member 11, and one or more swellings 20 extended from the outer peripheral fence 13 for forming or defining the recesses 19 of the outer peripheral fence 13. The lower housing member 11 further includes an axle or cylindrical member 21 extended from the other end 22 of the lower housing member 11 and preferably perpendicular to the lower housing member 11 and having a bore 23 formed in the cylindrical member 21, for pivotally coupling to various electric or radio facilities, such as portable or mobile phones, motor vehicles, global positioning systems, computer facilities, radio apparatuses or communications, etc.

It is preferable that the lower housing member 11 further includes an enlarged compartment 24 formed in the upper portion of the cylindrical member 21 and communicating with the chamber 12 of the lower housing member 11 and also communicating with the bore 23 of the cylindrical member 21, and further includes one or more bulges 25 extended into the enlarged compartment 24 of the cylindrical member 21 or of the lower housing member 11. The cylindrical member 21 preferable includes an outer peripheral groove 26 for engaging with such as clamping or retaining ring (not shown).

The housing 10 further includes a second or an upper housing member 30 having a chamber 31 formed in the lower portion thereof (FIGS. 1-2 and 5-6), and having an outer peripheral fence 32 extended downwardly from the outer peripheral portion 33 of the upper housing member 30 for forming or defining the chamber 31 of the upper housing member 30 and for receiving and storing the antenna member 50. The peripheral fence 32 of the upper housing member 30 is provided for engaging onto or around the outer peripheral fence 13 of the lower housing member 11, or for engaging into the outer peripheral shoulder 15 of the lower housing member 11, for securing the lower and the upper housing members 11, 30 together with such as a force-fitted engagement.

The upper housing member 30 further includes one or more protrusions 34 extended into the chamber 31 thereof from the peripheral fence 32 and aligned with the recesses 19 and the swellings 20 of the lower housing member 11 for engaging into the recesses 19 of the lower housing member 11 and for further solidly securing the lower and the upper housing members 11, 30 together. The upper housing member 30 further includes one or more projections 35 formed or extended from one end 36 of the upper housing member 30 and preferably located within the chamber 31 of the upper housing member 30 for engaging into the depressions 16 of the lower housing member 11 and for further solidly securing the lower and the upper housing members 11, 30 together.

Figure 7:
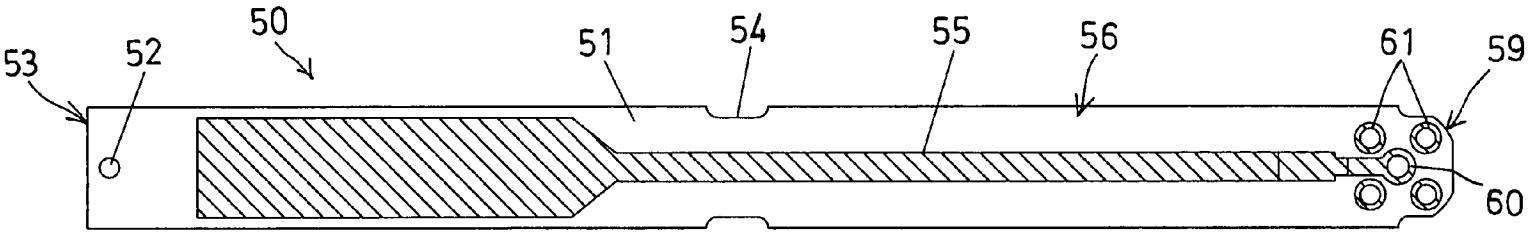
FIG. 7 is a top plan view of an antenna member of the antenna device.
Figure 8:
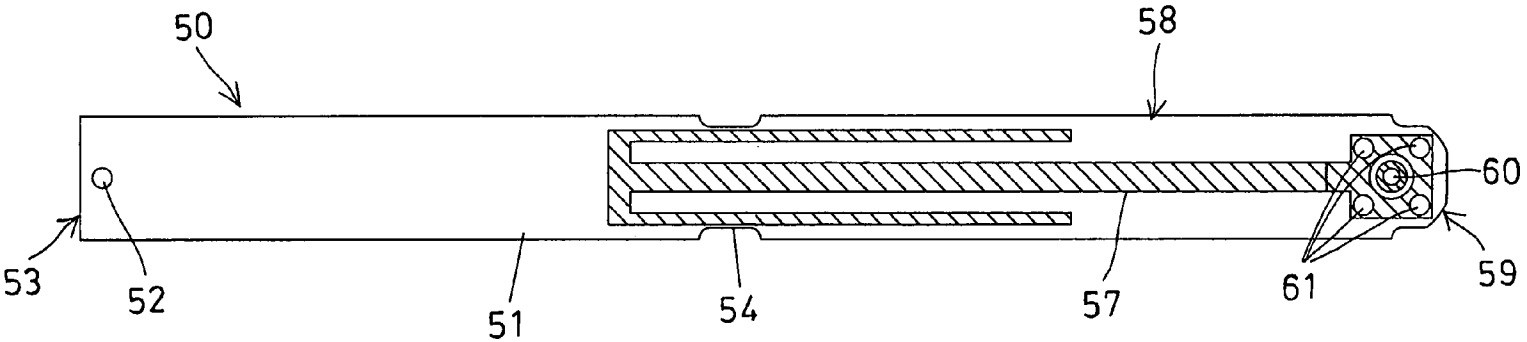
FIG. 8 is a bottom plan view of the antenna member of the antenna device.
Figure 9:
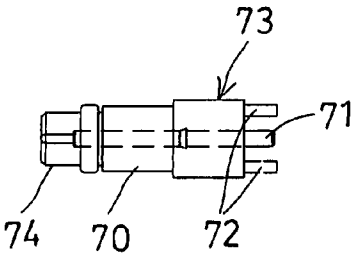
FIG. 9 is a plan schematic view illustrating a coupler for the antenna member of the antenna device.

The antenna member 50 includes a longitudinal plate 51 having one or more holes 52 formed in one end 53 (FIGS. 1 and 7-8) for receiving or engaging with the pegs 17 of the lower housing member 11 and for stably anchoring or positioning the antenna member 50 within the housing 10, such as within the chamber 12 of the lower housing member 11, the antenna member 50 may also be partially received or engaged within the chamber 31 of the upper housing member 30. The antenna member 50 further includes one or more notches 54 formed in the middle portion thereof for receiving or engaging within the swellings 20 of the lower housing member 11, and for further stably anchoring or positioning the antenna member 50 within either or both of the chambers 12, 31 of the lower and the upper housing members 11, 30.

The antenna member 50 includes a conductor member 55 disposed or applied onto one side 56, such as the upper portion 56 of the plate 51 for radiating signal receiving or transmitting purposes, and includes another E-shaped conductor member or grounding member 57 disposed or applied onto the other side 58, such as the lower portion 58 of the plate 51 for grounding purposes, and includes one or more orifices 60 and one or more apertures 61 formed in the other end portion 59 thereof, and the orifices 60 and the apertures 61 of the antenna member 50 are separated from each other.

A coupler 70 includes one or more positive terminals or electrodes 71 and one or more negative terminals or electrodes 72 extended from one end 73 thereof, and the positive and the negative terminals or electrodes 71, 72 are engaged through the orifices 60 and the apertures 61 of the antenna member 50 respectively, and electrically coupled or connected to the conductor member 55 and the grounding member 57 of the antenna member 50 respectively with such as welding processes, for solidly securing the coupler 70 to the antenna member 50. The coupler 70 is engaged in the bore 23 of the cylindrical member 21 and includes another end 74 extended out of the cylindrical member 21 for electrically coupling to various electric or radio facilities, such as portable or mobile phones, motor vehicles, global positioning systems, computer facilities, radio apparatuses or communications, etc.

The bulges 25 of the cylindrical member 21 or of the lower housing member 11 may be used to engage with the coupler 70 for positioning or anchoring the coupler 70 to the cylindrical member 21 or the lower housing member 11. The bulges 25 of the cylindrical member 21 or of the lower housing member 11 may also be used to engage with the antenna member 50 and for further solidly anchoring or positioning the antenna member 50 in either or both of the chambers 12, 31 of the lower and the upper housing members 11, 30.

The upper housing member 30 may include one or more anchoring elements 37 extended from the one end 36 thereof and one or more positioning elements 38 extended from the other end 39 thereof for engaging with the antenna member 50 and for further solidly anchoring or positioning the antenna member 50 in either or both of the chambers 12, 31 of the lower and the upper housing members 11, 30. The upper housing member 30 may further include one or more cavities 40 formed in the other end 39 thereof (FIG. 5) for receiving or engaging with the positive and the negative terminals or electrodes 71, 72 of the coupler 70, and for further solidly anchoring or positioning the coupler 70 to the lower and the upper housing members 11, 30 of the housing 10.

The antenna device includes a compact covering or housing 10 for receiving and storing the antenna member 50 therein and for easily and readily and rotatably or pivotally attaching or coupling the antenna device to various electric or radio facilities. In addition, the typical antenna devices failed to provide a conductor member 55 on one side 56 for radiating signal receiving or transmitting purposes, and a grounding member 57 on the other side 58 for grounding purposes.

Accordingly, the antenna device in accordance with the present invention includes a compact covering device for covering and storing an antenna member therein and for rotatably or pivotally attaching or coupling the antenna device to various electric or radio facilities.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An antenna device comprising:

a housing including a first housing member having a chamber and having a cylindrical member extended from said first housing member, said first housing member including at least one peg, an antenna member received in said chamber of said first housing member, said at least one peg of said first housing member being engaged with said antenna member for anchoring said antenna member in said chamber of said housing, and said antenna member including at least one hole for receiving said at least one peg of said first housing member, a second housing member attached onto said first housing member for retaining said antenna member between said first and said second housing members, and a coupler attached to said antenna member and engaged in said cylindrical member of said first housing member.

2. The antenna device as claimed in claim 1, wherein said first housing member includes at least one swelling for engaging with said antenna member and for anchoring said antenna member in said chamber of said housing.

3. The antenna device as claimed in claim 1, wherein said first housing member includes at least one depression, said second housing member includes at least one projection for engaging into said at least one depression of said first housing member and for securing said first and said second housing members together.

4. The antenna device as claimed in claim 1, wherein said first housing member includes an outer peripheral shoulder, said second housing member includes an outer peripheral fence engaged into said outer peripheral shoulder of said first housing member.

5. An antenna device comprising:

a housing including a first housing member having a chamber and having a cylindrical member extended from said first housing member, said first housing member including at least one swelling, an antenna member received in said chamber of said first housing member, said at least one swelling of said first housing member being engaged with said antenna member and for anchoring said antenna member in said chamber of said housing, and said antenna member including at least one notch for receiving said at least one swelling of said first housing member, a second housing member attached onto said first housing member for retaining said antenna member between said first and said second housing members, and a coupler attached to said antenna member and engaged in said cylindrical member of said first housing member.

* * * * *